US006984356B2

(12) United States Patent
Hur et al.

(10) Patent No.: US 6,984,356 B2
(45) Date of Patent: Jan. 10, 2006

(54) METHOD AND APPARATUS FOR THE CONTINUOUS PRODUCTION OF FOAMED METALS

(75) Inventors: Bo Young Hur, 35-312 Material Engineering Dept., College of Engineering, Kyungsang University, 900 Gajwa-dong, Jinju City, 660-701, Kyungsangnam-do (KR); Soon Hyung Cho, 503-402 Hyundai Apt., Kwangjang-dong, Kwang jin-ku 143-755, Seoul (KR); Ki Bae Kim, New Metalic Material Research Center, Korea Institute of Science and Technology, 39-1 Hawolgok-dong, Sungbuk-ku 136-791, Seoul (KR); Seok Choun Bae, Daegu (KR)

(73) Assignees: Bo Young Hur, Jinju (KR); Ki Bae Kim, Seoul (KR); Soon Hyung Cho, Seoul (KR)

( * ) Notice: Subject to any disclaimer, the term of this patent is extended or adjusted under 35 U.S.C. 154(b) by 0 days.

(21) Appl. No.: 10/947,440

(22) Filed: Sep. 23, 2004

(65) Prior Publication Data

US 2005/0035502 A1 Feb. 17, 2005

Related U.S. Application Data

(62) Division of application No. 10/336,765, filed on Jan. 6, 2003, now Pat. No. 6,863,709.

(30) Foreign Application Priority Data

Jan. 7, 2002 (KR) ..... 2002-725

(51) Int. Cl.
*C21D 11/00* (2006.01)

(52) U.S. Cl. ..... 266/90; 266/217

(58) Field of Classification Search ..... 266/90, 266/217
See application file for complete search history.

(56) References Cited

U.S. PATENT DOCUMENTS 5,112,697 A 5/1992 Jin et al.
5,281,251 A * 1/1994 Kenny et al. ..... 75/415
5,584,983 A 12/1996 Pruyn
6,712,124 B1 * 3/2004 Yamane et al. ..... 164/468

FOREIGN PATENT DOCUMENTS

TW 418130 * 1/2001

OTHER PUBLICATIONS

Derwent-ACC-:2001-365891 Derwent Week:200138 TW418130A.*
WPIDS AN 2001-365891 TW 418130A.*

* cited by examiner

*Primary Examiner*—Melvyn Andrews
(74) *Attorney, Agent, or Firm*—Staas & Halsey LLP

(57) ABSTRACT

A method for continuously producing foamed metals is disclosed. The method comprises the steps of (i) adding a previously dissolved molten metal to a viscosity-enhancing furnace and agitating the molten metal so as to uniformly maintain the viscosity of the molten metal; (ii) conveying the molten metal to an electronic agitating type foaming furnace; (iii) injecting gas into the conveyed molten metal while agitating to obtain a foamed molten metal; and (iv) drawing the obtained foamed molten metal using a roller and cooling the drawn foamed metal.

6 Claims, 2 Drawing Sheets

METHOD AND APPARATUS FOR THE CONTINUOUS PRODUCTION OF FOAMED METALS

This application is a divisional of Ser. No. 10/336,765 now U.S. Pat. No. 6,836,709, filed Jan. 6, 2003, the disclosure of which is incorporated by reference, which claims the benefit of Korean Patent Application No. 2002-725, filed Jan. 7, 2002 in the Korean Intellectual Property Office.

BACKGROUND OF THE INVENTION

1. Field of the Invention

The present invention relates to a method and an apparatus for continuously producing foamed metals, and more particularly to a method and an apparatus for continuously producing an ultralight foamed aluminum or aluminum alloy by conveying molten metal furnished from a viscosity-enhancing furnace to a foaming furnace, and injecting gas into the conveyed foaming furnace while agitating the molten metal using an electronic agitating system.

2. Description of the Related Art

Foamed metals, in particular foamed aluminums contain a number of foams in a metal matrix. The foamed metals are similar to polyurethane, foamed glasses or foamed concrete in appearance.

Since foamed aluminum commonly has a porosity of above 90%, its specific gravity is within the range of from 0.2 to 1.0 and thus it is very light. Accordingly, foamed aluminum is an excellent material for sound absorption, sound insulation and shock absorption. In addition, since the matrix is aluminum, the foamed aluminum has excellent fire resistance, heat resistance, strength, and workability. Due to these properties, the foamed aluminum is also used as a functional material. Furthermore, the foamed aluminum has decorative surface peculiar to aluminum, and thus can be used as an interior finish for construction. To these uses, it is expected that the foamed aluminum can be used as a sound absorption material and is useful as a material in the manufacture of automobiles, vehicles, ships, etc., using the lightness and strength of foamed aluminum.

For better properties, foamed aluminum must have an uniformity in type and size of foams and must be produced in a simpler process.

U.S. Pat. No. 5,112,697 discloses a process for continuously producing stabilized metal foam body by dispersing stabilized particles such as $Al_2O_3$ in a metal matrix, infiltrating molten metal into the stabilized particles, and injecting gas into a space inside an impeller while rotating the impeller. However, this process has limitations that the stabilized particles must impart a uniform viscosity to the molten metal and prevent them from being drained. Accordingly, the volume fraction and size of stabilized particles are very important factors. In addition, the shape and angle of impeller are important factors since gas injection is accomplished through hollows of impeller. For these reasons, control system must be sophisticated. Otherwise, foamed metals with low quality may be produced. Accordingly, there remains a need to develop a method for continuously producing foamed metals with high quality in a simpler manner.

The conventional method for continuously producing foamed metals increases the viscosity of the foamed metals and trap the generated foams by using stabilized particles, It maintains sufficient viscosity by adding Ca—Al alloy to a separate melting furnace before foams occur in molten metal. The viscosity is also increased by controlling a solid state percentage by adjusting the temperature of molten metal below liquefying temperature. Gas injection has made by placing a membrane on the bottom of furnace and injecting a gas into molten metal through the membrane. Then, the injected gas is homogeneously distributed in the molten metal by rotating an impeller arranged in the furnace. And thereafter a foamed metal is obtained by coagulating the molten metal. This method has many advantages that expensive stabilized particles have no need to be added, and processes such as selection of stabilized particles and preheat can be omitted. In addition, processing time is minimized since the viscosity of molten metal is previously adjusted. The gas injection through membrane is safer, and the used impeller is manufactured by a simpler manner, compared with conventional impeller.

However, since all these methods always use impellers. It is difficult to select a material suitable for each impeller. Further, breakage of the impeller influences the quality of the final product, and generates a troublesome such as impeller exchange. Agitating blades cannot smoothly agitate molten metal because of the increased viscosity of the molten metal due to addition of a viscosity-enhancing agent.

Therefore, a method for continuously producing foamed metals with high quality must satisfy the requirements as below:

i) molten metal has a uniform viscosity so as to trap foams in the molten metal. This inhibits foams contained in the molten metal from running out from the molten metal; ii) foams trapped in the molten metal must be homogenously dispersed within the molten metal. For this purpose, the efficiency of agitator must be improved; and iii) impeller must not be broken during agitating, and the agitation must be softly carried out.

SUMMARY OF THE INVENTION

The present inventors have earnestly researched in order to solve these problems, and as a result, have found a method for continuously producing ultralight foamed metals with high porosity which comprises adding a metal and, if necessary, a viscosity-enhancing agent to a viscosity-enhancing furnace and melting the metal, and agitating the molten metal by means of an electronic agitating system instead a mechanical impeller. According to the above findings, foams can be homogeneously dispersed in molten metal.

Accordingly, it is an object of the present invention to provide a method for continuously producing ultralight foamed metals with high porosity by adding a metal and, if necessary, a viscosity-enhancing agent to a viscosity-enhancing furnace, and conveying the mixture a foaming furnace to obtain desired foamed metals.

It is another object of the present invention to provide an apparatus for continuously producing ultralight foamed metals with high porosity.

The above objectives and additional advantages are realized in a method for producing foamed metals according to the present invention comprising the steps of: (i) adding a previously dissolved molten metal to a viscosity-enhancing furnace and agitating the molten metal so as to uniformly maintain the viscosity of the molten metal; (ii) conveying the molten metal to an electronic agitating type foaming furnace; (iii) injecting gas into the conveyed molten metal while agitating to obtain a foamed molten metal; and (iv) drawing the obtained foamed molten metal using a roller and cooling the drawn foamed metal.

The molten metal may comprise one selected from the group consisting of aluminum and an aluminum alloy.

The method may further comprise the step of adding a viscosity-enhancing agent to the viscosity-enhancing furnace after the molten metal is added thereto.

The viscosity-enhancing agent may comprise Ca—Al alloy, and be added in an amount of from 0.1 to 10.0% by weight, based on the weight of the molten metal.

The viscosity-enhancing agent may be added in an amount of from 0.5 to 5.0% by weight, based on the weight of the molten metal.

The temperature of the foaming furnace in Step (iii) may be controlled so that the value of the solid-state percentage of the conveyed molten metal is a range of 1~10%.

The space pressure in the foaming furnace may be adjusted to from 1 to 10 atm.

The diameter of foam may have a range of 0.1 to 50 mm in the agitating step.

The injection gas may includee one selected from air, $CO_2$, $O_2$, or an inert gas and the value of injection pressure is a range of 1~20 psi.

Also, the above objectives and additional advantages are realized in an apparatus for producing foamed metals comprising: a viscosity-enhancing furnace including a body for accommodating molten material, an agitator for agitating the molten material in the body, and a drain hole for draining the molten material; a conveying means connected with the drain hole of the viscosity-enhancing furnace for conveying the molten material; and a foaming furnace connected to the viscosity-enhancing furnace via the conveying means for foaming the molten material conveyed from the viscosity-enhancing furnace by an electronic agitating system under gas environment.

The viscosity-enhancing furnace may further comprise a cover for covering the upper part of the body, and the cover has an opening for introducing the molten material.

The conveying means may include a shut-off valve for controlling the amount of the molten material.

The foaming furnace may include an inlet for introducing the molten metal from the conveying means, a gas inlet for introducing gas, a membrane positioned at the gas inlet, and an electronic agitating system for dispersing and atomizing the introduced gas to foam the molten material, and a hole for draining the foamed material.

The apparatus may further comprise rollers positioned at the exterior of the hole of the foaming furnace for drawing the foamed material.

The agitator may be driven by a motor.

The molten material may comprise one selected from a molten metal, a viscosity-enhancing agent and the both thereof.

The molten metal may be aluminum or an aluminum alloy.

BRIEF DESCRIPTION OF THE DRAWINGS

The foregoing and other objects, features and advantages of the present invention will become more apparent from the following detailed description when taken in conjunction with the accompanying drawings in which.

DESCRIPTION OF THE PREFERRED EMBODIMENTS

Figure 1:
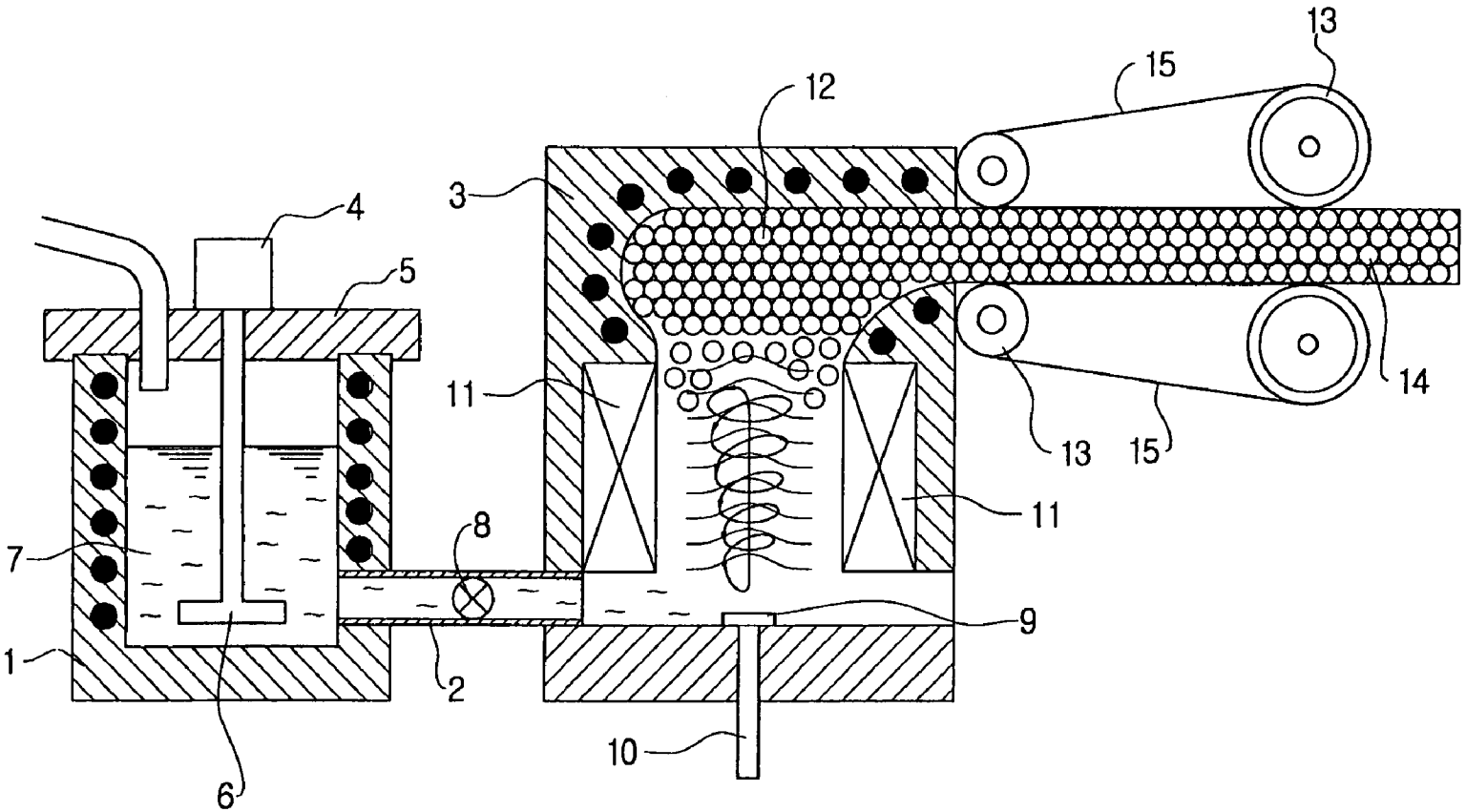
FIG. 1 is a schematic view showing an apparatus for continuously producing foamed metals according to the present invention.

A method for the production of foamed metals according to the present invention comprises the steps of:

(i) adding a previously dissolved molten metal to a viscosity-enhancing furnace and agitating the molten metal so as to uniformly maintain the viscosity of the molten metal;

(ii) conveying the molten metal to an electronic agitating type foaming furnace;

(iii) injecting gas into the conveyed molten metal while agitating to obtain a foamed molten metal; and (iv) drawing the obtained foamed molten liquid using a roller and cooling.

The metal used herein is preferably aluminum or an aluminum alloy.

In Step (i), the temperature of the molten metal in the viscosity-enhancing furnace is set to equal to or below the melting point of the molten metal so as to uniformly maintain the viscosity of the molten metal. In the case of melting at a temperature of above the melting point, it is necessary to maintain the viscosity using the viscosity-enhancing agent.

The viscosity-enhancing agent is used for increasing the viscosity of the molten metal and trapping the generated foams. The viscosity-enhancing agent used herein is Ca—Al alloy. For example, when the molten metal is aluminum, Ca-10 wt % Al alloy is preferred, and the amount of viscosity-enhancing agent added is from 0.1 to 10.0% by weight, and preferably from 0.5 to 5.0% by weight, based on the weight of the molten metal. To uniformly mix the viscosity-enhancing agent with the molten metal, the addition of the viscosity-enhancing agent to the molten metal must be slowly performed. After the addition of the viscosity-enhancing agent is finished, agitation is continuously made for a time to improve the dispersion of the viscosity-enhancing agent. The agitation speed of agitator is maintained such that foams cannot run out from inside the molten metal when gas is injected into the furnace.

In step (ii), the molten metal is conveyed to the electronic agitating type foaming furnace through a conveying means. The amount of the molten metal conveyed is controlled by a shut-off valve arranged in the conveying means.

In step (iii), the temperature of the foaming furnace is controlled so that the solid-state percentage of the conveyed molten metal corresponds to 1~10%. The agitating method of the present invention used to disperse and atomize the injected gas is characterized in that the agitation is practiced by an electronic agitating system. The atomized foams have a diameter of from about 0.1 to about 50 mm. The injection gas includes air, $CO_2$, $O_2$, an inert gas and etc., and injecting pressure is within 1 to 20 psi. Gas can be injected from the lower part, side part or upper part of the foaming furnace, and is particularly not limited to these parts. Foamed metal containing foams rises to the upper part of the furnace and forms a foamed molten metal. The risen foamed molten metal is pressurized within the closed furnace and thus becomes a more homogeneous foamed molten metal. The space pressure above the upper surface of the foamed molten metal is preferably adjusted to from 1 to 10 atm. Agitation by the electronic agitating system is continuously carried out. The capacity and agitating speed of the electronic agitating system depend on the amount of the molten metal, solid-state percentage, and injection amount of gas.

In step (iv), the foamed molten metal obtained in Step (iii) is drawn using the rotation of rollers, and cool to produce a foamed metal solid. Rollers form the foamed metal into a desired shape. The thickness and width of the foamed metal solid depend on the interval and width of the rollers. Uniform velocity and strength guarantee a foamed metal with high quality. Cooling method may be air-cooling or a forced cooling method, but is particularly not limited to these methods.

The present invention also relates to an apparatus used for producing foamed metals.

Hereinafter, the apparatus according to the present invention will be explained in more detail with reference to the accompanying drawings.

As shown in FIG. 1, the apparatus for producing foamed metals according to the present invention comprises a viscosity-enhancing furnace 1, a conveying means 2, a foaming furnace 3 and rollers 13.

The a viscosity-enhancing furnace 1 includes a body for accommodating molten metal and/or viscosity-enhancing agent 7 (hereinafter referred to molten metal), a cover 5 for covering the upper part of the body, an agitator 6 for agitating the molten material in the body, and a drain hole for draining the molten material 7. The cover 5 has an opening for inserting a pipe for introducing the molten metal.

The conveying means is connected with the drain hole of the viscosity-enhancing furnace for conveying the molten material 7 and has a shut-off valve 8 for controlling the amount of the molten metal 7.

The foaming furnace 3 is connected to the viscosity-enhancing furnace via the conveying means for foaming the molten material conveyed from the viscosity-enhancing furnace 1 by an electronic agitating system 11. The foaming furnace 3 also includes an inlet for introducing the molten metal from the conveying means, a gas inlet for inserting a pipe 10 for introducing gas, a membrane 9 positioned at the gas inlet, and an electronic agitating system 11 for dispersing and atomizing the introduced gas to foam the molten material, and a hole for draining the foamed molten metal 12 to the exterior. The electronic agitating system 11 is arranged to surround the interior the foaming furnace 3.

The rollers 13 are positioned at the exterior of the hole of the foaming furnace 3 to draw the foamed molten metal 12. The rollers 13 are connected with endless belt 15. The foamed molten metal 12 is drawn along the belt 15 to the exterior.

Also, heater (indicated as symbol in FIG. 1) and temperature controller (not shown) are arranged around the viscosity-enhancing furnace 1 and the foaming furnace 3 so as to constantly maintain the temperature of each furnace.

The previously dissolved molten metal is introduced into the viscosity-enhancing furnace 1 via the pipe inserted into the opening of the viscosity-enhancing furnace 1, and then the viscosity-enhancing agent may be added thereto. Subsequently, the upper part 5 of the furnace 1 is set down and closed firmly.

The molten metal 7 is conveyed by using the law of gravity through the conveying means 2 because the location of the furnace 1 is higher than the foaming furnace 3. Otherwise the molten metal 7 is conveyed to the furnace 3 using the pressure difference generated by pressurizing the interior the furnace 1. The shut-off valve 8 arranged the conveying means 2 controls the amount of the molten metal 7 conveyed, and prevents the conveyance of the molten metal 7 to the foaming furnace 3 until the viscosity increasing process is completely finished.

The sensor (not shown) can be adjust the conveyed amount of the molten metal 7 controlled by shut-off valve 8 to the generated amount of the foamed metal solid 14. The gas is provided to the foaming furnace 3 via the membrane 9. The heater(not shown)arranged around the foaming furnace 3 adjusts the temperature of the furnace 3 to maintain the solid-state percentage of the conveyed molten metal 7 constantly. The gas pipe 10 includes a gas controller (not shown) to maintain pressure within the foaming furnace 3. The membrane 9 is made of a ceramic material that gas can pass through. The electronic agitating system 11 (standard type induced rotation unit, manufactured by KIST) used herein is arranged around the foaming furnace 3.

Rollers 13 used herein are general apparatus for drawing the foamed molten metal 12. Also to solidify the foamed molten metal 12, a general cooling means may be used.

The present invention will now be described in more detail with reference to the following Examples. However, these examples are given by way of illustration and not of limitation.

EXAMPLE 1

Production of Foamed Aluminum Solid 10 kg of dissolved aluminum was added to a viscosity-enhancing furnace 1 maintained at 700~750° C. and then 500 g of Ca-10 wt % Al alloy was added thereto at a speed of 5~30 kg/min. The mixture was agitated for 30 minutes using an agitator 3 under 0~500 rpm. The molten aluminum was conveyed to a foaming furnace 3 maintained at 660~700° C., and air provided from a gas pipe 10 was injected into the molten aluminum through a membrane 9. The air pressure was controlled to 1~20 psi. To uniformly disperse and atomize the air in the molten aluminum, electronic agitating system 11 (standard type induced rotation unit, manufactured by KIST) was used for 30 seconds~10 minutes under the conditions below:

Speed: 200~1500 rpm

Current: 200~500 A,

Magnetic flux density: 500~1200 Gauss

Figure 2:
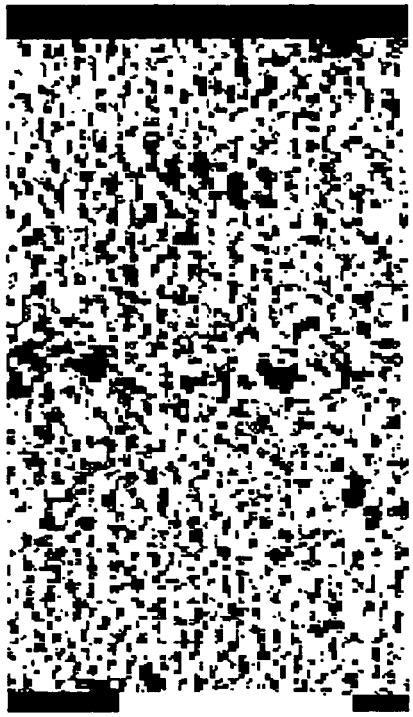
FIG. 2 is a metallographic photograph of a foamed aluminum solid produced according to Example 1 of the present invention.

The space pressure above the upper surface of the molten aluminum was adjusted to 1~10 atm to obtain a homogeneous foamed aluminum liquid. The foamed aluminum liquid thus obtained was drawn by a pair of rollers 13 and cooled to produce a foamed aluminum solid. The porosity of the foamed-aluminum solid was 90%. The metallographic photograph is shown in FIG. 2.

COMPARATIVE EXAMPLE 1

Production Foamed Aluminum Alloy Solid

Figure 3:
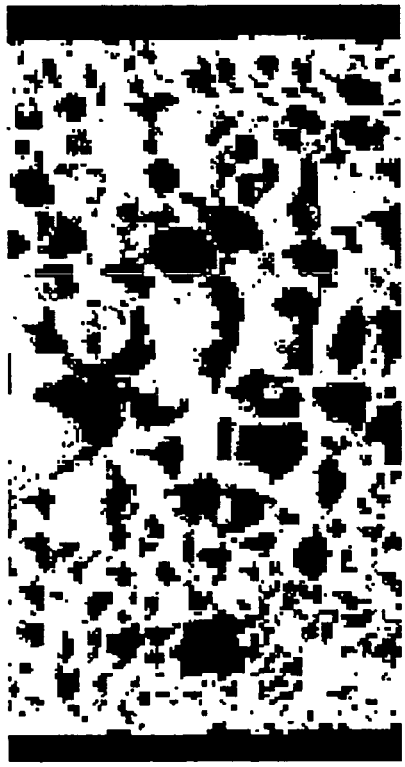
FIG. 3 is a metallographic photograph of a foamed aluminum solid produced according to Comparative Example 1 of the present invention.

The title foamed aluminum alloy solid was produced in the same manner as in Example 1 except that the space pressure above the upper surface of the molten aluminum was adjusted to less than 1 atm. The metallographic photograph is shown in FIG. 3. As can be seen in FIG. 3, the size of foams is larger and the distribution of foams is less homogeneous, compared with FIG. 2.

EXAMPLE 2

Production of Foamed Aluminum Alloy Solid 10 kg of dissolved Al-5 wt % Si aluminum alloy was added to a viscosity-enhancing furnace maintained at 577~640° C. The aluminum alloy was agitated for 5~30 minutes using an agitator 3 at a speed of 0~500 rpm. The molten aluminum was conveyed to a foaming furnace 3 maintained at a temperature of 577~640° C., and air provided from a gas pipe 10 was injected into the molten aluminum alloy through a membrane 10 after adjusting the temperature of the furnace 3 until the solid-state percentage of the aluminum alloy was 1~10%. The air pressure was controlled to 1~20 psi. To uniformly disperse and atomize the air in the molten aluminum, electronic agitating system 11 (standard type induced rotation unit, manufactured by KIST) was used for 30 seconds~10 minutes under the conditions below:

Speed: 200~1500 rpm

Current: 200~500 A,

Magnetic flux density: 500~1200 Gauss

The space pressure above the upper surface of the molten aluminum was appropriately adjusted to obtain a homogeneous foamed aluminum liquid. The foamed aluminum alloy liquid thus obtained was drawn by a pair of rollers 13 and cooled to produce a foamed aluminum alloy solid. The porosity of the foamed aluminum solid was 90%.

The ultralight foamed metals produced in accordance with the present invention have high porosity, and uniform type and size of foams. In addition, the agitation is softly carried out, compared with conventional agitations using a mechanical impeller. Therefore, the foamed metals according to the present invention are very useful materials in the technical fields that require fire resistance, heat resistance, strength, workability, sound absorption, sound insulation and shock absorption.

What is claimed is:

1. An apparatus for producing foamed metals, the apparatus comprising:

a viscosity-enhancing furnace including a body for accommodating molten material, an agitator for agitating the molten material in the body, and a drain hole for draining the molten material;

a conveying means connected with the drain hole of the viscosity-enhancing furnace for convening the molten material; and a foaming furnace connected to the viscosity-enhancing furnace via the conveying means for foaming the molten material conveyed from the viscosity-enhancing furnace by an electronic agitating system under gas environment.

2. The apparatus according to claim 1, wherein the viscosity-enhancing furnace further comprises a cover for covering the upper part of the body, and the cover has an opening for introducing the molten material.

3. The apparatus according to claim 1, wherein the conveying means includes a shut-off valve for controlling the amount of the molten material.

4. The apparatus according to claim 1, wherein the foaming furnace includes an inlet for introducing the molten metal from the conveying means, a gas inlet for introducing gas, a membrane positioned at the gas inlet, and an electronic agitating system for dispersing and atomizing the introduced gas to foam the molten material, and a hole for draining the foamed material.

5. The apparatus according to claim 4, further comprises rollers positioned at the exterior of the hole of the foaming furnace for drawing the foamed material.

6. The apparatus according to claim 1, wherein the agitator is driven by a motor.

* * * * *